US010901359B1

(12) United States Patent
Maruyama

(10) Patent No.: US 10,901,359 B1
(45) Date of Patent: Jan. 26, 2021

(54) IMAGE PROCESSING APPARATUS, PAPER DUST COLLECTION MECHANISM, AND PAPER DUST COLLECTION METHOD

(71) Applicant: TOSHIBA TEC KABUSHIKI KAISHA, Tokyo (JP)

(72) Inventor: Shinji Maruyama, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/813,917

(22) Filed: Mar. 10, 2020

(51) Int. Cl.
*G03G 21/00* (2006.01)
*G03G 21/10* (2006.01)
*G03G 21/12* (2006.01)

(52) U.S. Cl.
CPC ..... *G03G 21/10* (2013.01); *G03G 21/12* (2013.01)

(58) Field of Classification Search
CPC ..... G03G 15/6529; G03G 15/6558; G03G 21/10; G03G 21/12
USPC ..... 399/98, 358, 360
See application file for complete search history.

(56) References Cited

U.S. PATENT DOCUMENTS 5,740,498 A * 4/1998 Tsuchiya ..... G03G 15/6558 399/98
7,149,456 B2 * 12/2006 Yamagata ..... G03G 15/6558 399/98
9,008,536 B2 * 4/2015 Hashimoto ..... G03G 15/6558 399/98
10,452,018 B2 * 10/2019 Maeda et al. ..... G03G 15/6529

FOREIGN PATENT DOCUMENTS

JP 2014-182235 9/2014

* cited by examiner

*Primary Examiner* — William J Royer
(74) *Attorney, Agent, or Firm* — Amin, Turocy & Watson, LLP

(57) ABSTRACT

An image processing apparatus includes a paper feeding unit on which paper is placed; an image forming unit that forms an image on the paper supplied from the paper feeding unit; a paper conveying roller that conveys the paper from the paper feeding unit by rotation in contact with the paper; a reservoir that contains paper dust removed from the paper conveying roller and includes a bottom portion; a waste toner container that is disposed below the reservoir in a vertical direction, is detachable from the image processing apparatus, and contains a waste toner discharged from the image forming unit; and a transfer path that connects an inside portion of the reservoir and an inside portion of the waste toner container.

20 Claims, 5 Drawing Sheets

IMAGE PROCESSING APPARATUS, PAPER DUST COLLECTION MECHANISM, AND PAPER DUST COLLECTION METHOD

FIELD

Embodiments described herein relate generally to an image processing apparatus, a paper dust collection mechanism, and a paper dust collection method.

BACKGROUND

Paper used in an image processing apparatus that forms an image on paper or removes an image makes paper dust in various processes when the paper is produced, distributed, and set in the image processing apparatus. The origin of the paper dust is a chip generated from a cut edge of the paper when the paper is cut, a fiber piece peeled off from the surface of the paper, or the like. Paper dust adheres to the surface of the paper used in the image processing apparatus.

When the image processing apparatus forms an image on paper, the paper is conveyed from a paper feed cassette, a manual feed tray, or the like, to an image forming unit that performs printing. The paper is conveyed from a paper conveying roller such as a pickup roller, a registration roller, or the like to the image forming unit. The paper is conveyed in contact with the rotating paper conveying roller.

When the paper and the paper conveying roller are in contact with each other, paper dust is transferred to the paper conveying roller. The paper dust is accumulated on the surface of the paper conveying roller. The paper dust particularly accumulates at a position corresponding to the center of the paper. Therefore, for example, as small size paper is continuously conveyed, paper dust accumulates on the surface of the paper conveying roller at a position corresponding to the center of the small size paper. If paper larger than the small size paper is conveyed in a state in which paper dust is accumulated on the surface of the paper conveying roller, the paper dust accumulated on the surface of the paper conveying roller is transferred back to the surface of the large size paper. Therefore, at a position corresponding to the center of the small size paper in the large size paper, ink adheres only to paper dust and does not adhere to the paper so that printing failure occurs.

In order to prevent the printing failure, a scraping blade that abuts on the paper conveying roller is disposed on the image processing apparatus so that the paper dust that adheres to the surface of the paper conveying roller is not transferred back to the paper.

However, in order to prevent the container that stores the paper dust scraped from the paper conveying roller from being full so that the paper dust is not inserted into the image processing apparatus, the paper dust needs to be collected or the container needs to be replaced before the container becomes full, and the collection or the replacement requires time.

DETAILED DESCRIPTION

The image processing apparatus of an exemplary embodiment includes a device main body, an image forming unit, a paper feeding unit, a paper conveying roller, a reservoir, a waste toner container, and a transfer path. The paper feeding unit is provided in the device main body, and paper is placed thereon. The paper conveying roller is provided in the inside portion of the device main body, rotates in contact with paper, and conveys paper from the paper feeding unit. The reservoir contains the paper dust removed from the paper conveying roller and includes a bottom portion. The waste toner container is disposed below the reservoir in the vertical direction, is detachable from the device main body, and contains waste toner discharged from the image forming unit. The transfer path connects the inside portion of the reservoir and the inside portion of the waste toner container. A paper dust collection method involves forming an image on paper supplied from a paper feeding unit by an image forming unit; conveying paper from the paper feeding unit by rotation of a paper conveying roller in contact with the paper; removing paper dust from the paper conveying roller and delivering the paper dust to a reservoir including a bottom portion; collecting waste toner discharged from the image forming unit in a waste toner container disposed below the reservoir in a vertical direction, the waste toner container detachable from the image processing apparatus; and collecting paper dust in the waste toner container via a transfer path connecting an inside portion of the reservoir and an inside portion of the waste toner container.

Hereinafter, the image processing apparatus according to the exemplary embodiment is described with reference to drawings. In the present specification, the depth direction, the front-rear direction, and the up-down direction are defined as follows. The depth direction is a direction extending to an axis of the paper conveying roller provided in the device main body of the image processing apparatus. The front-rear direction is a direction in which paper placed on a paper feed cassette is sent to the device main body. The up-down direction is a vertical direction. The depth direction is perpendicular to the front-rear direction and the up-down direction. The arrow X direction is the near side. The arrow Y direction is the front side. The arrow Z direction is the upper side.

Figure 1:
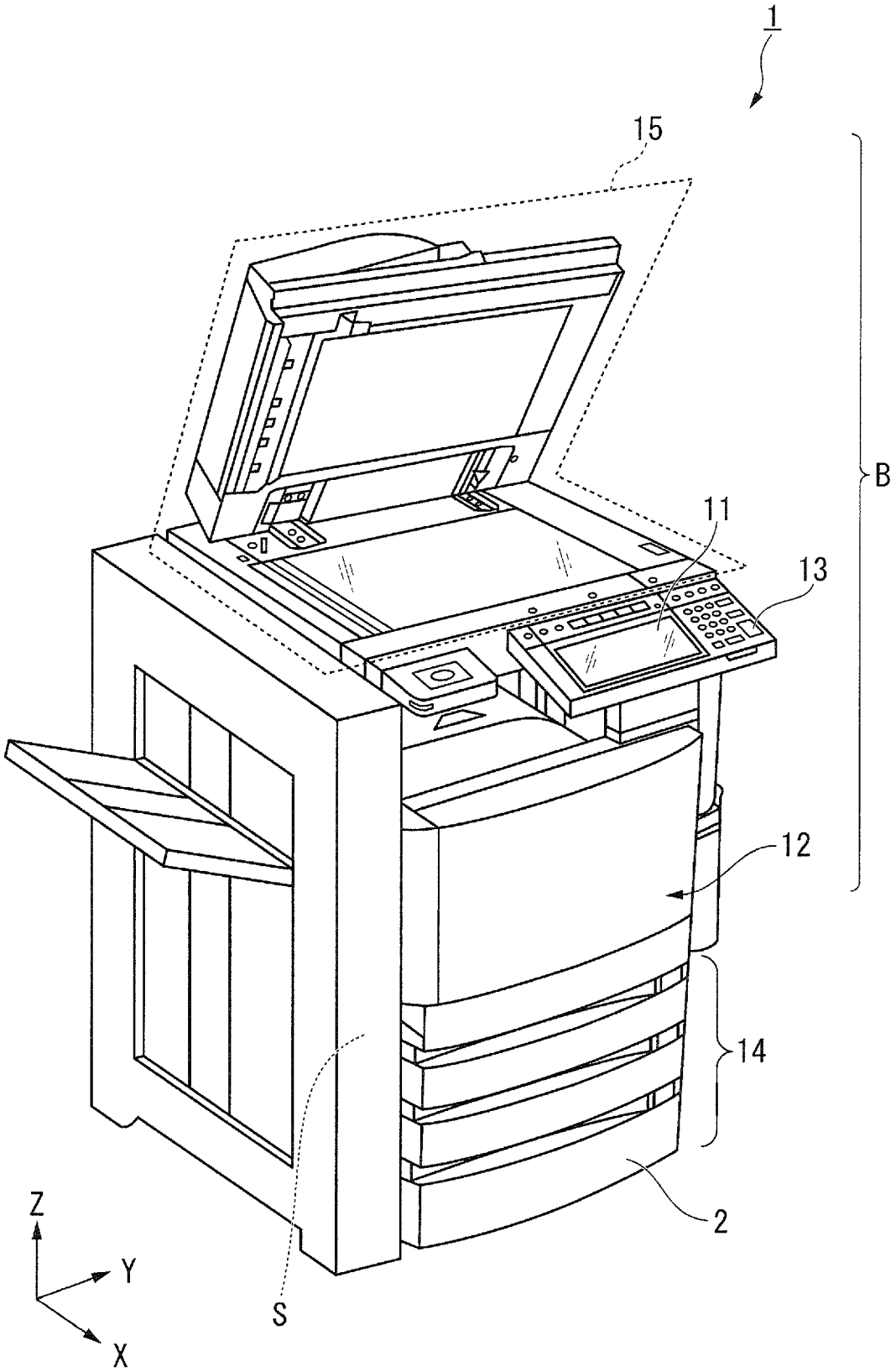
FIG. 1 is a perspective view of an image processing apparatus according to a first exemplary embodiment.

FIG. 1 is a perspective view of an image processing apparatus 1 according to the exemplary embodiment. The image processing apparatus 1 according to the exemplary embodiment is, for example, an image forming device such as a multi function printer (MFP) or a copying machine. Hereinafter, an example in which the image processing apparatus 1 is the image forming device illustrated in FIG. 1 is described.

Figure 2:
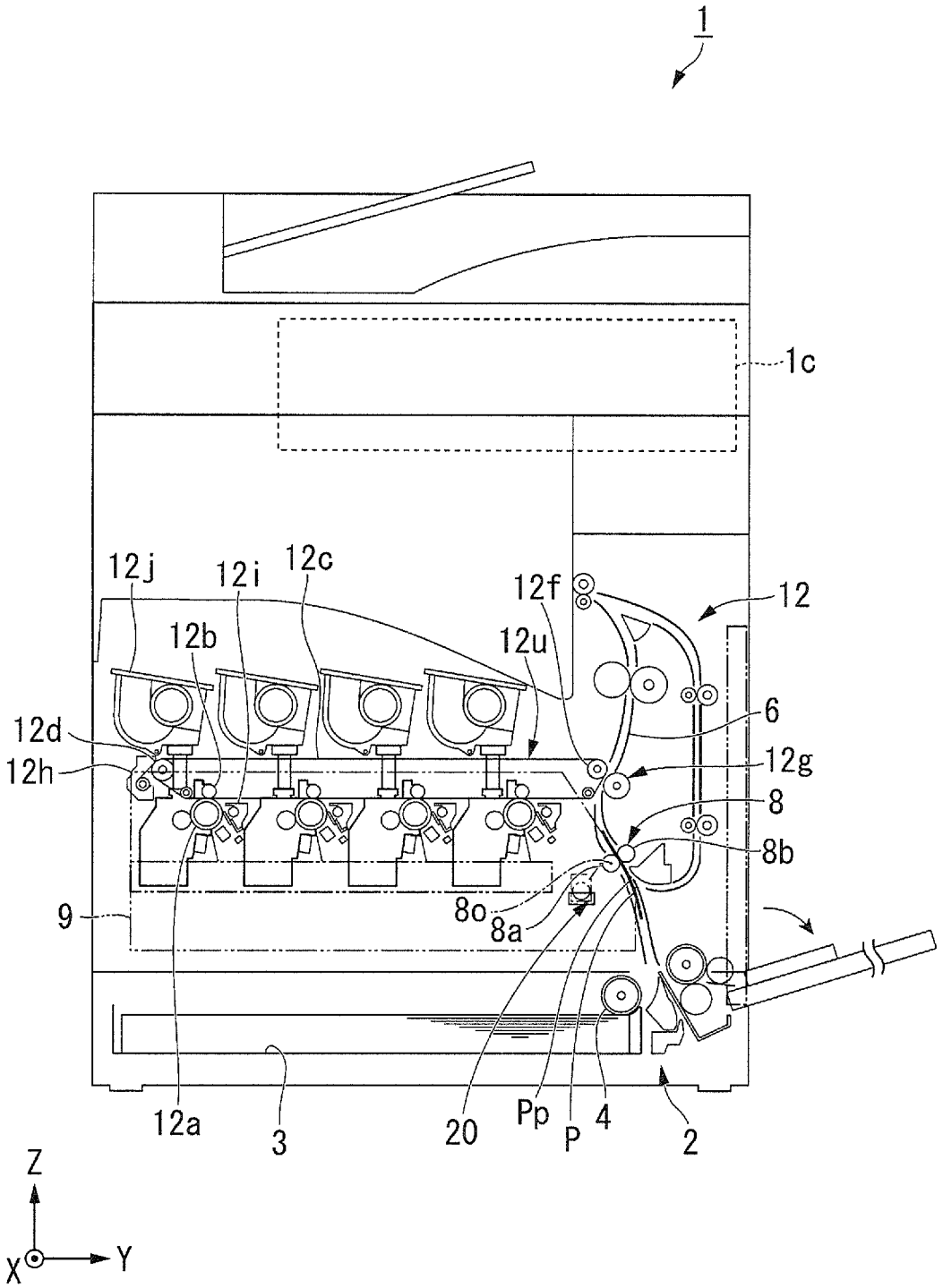
FIG. 2 is a diagram illustrating a configuration of an inside portion of the image processing apparatus.

FIG. 2 is a diagram illustrating a configuration of an inside portion of the image processing apparatus 1. As illustrated in FIGS. 1 and 2, the image processing apparatus 1 includes a controller 1*c*, a display 11, an image forming unit 12, a control panel unit 13, a paper containing unit 14, an image reading unit 15, a paper conveyance path 6, and a paper dust collecting mechanism 20.

The controller 1*c* is a program-executable processing device that includes a processor, a memory capable of reading a program, a storage device capable of storing programs and data, and an input and output device, and also includes other dedicated hardware. The function of the image processing apparatus 1 is implemented by causing the processor to execute the program provided in the controller 1*c*.

As illustrated in FIG. 1, the display 11, the image forming unit 12, the control panel unit 13, and the image reading unit 15 form a main body B of the image processing apparatus 1. The display 11 and the control panel unit 13 are used when a user operates the image processing apparatus 1 and checks or inputs operation details. The image reading unit 15 reads a character or an image printed on paper and forms electronic data.

The image forming unit 12 forms an image on a paper P. The image forming unit 12 forms an image on the paper P based on an operation instruction received by the main body B. As illustrated in FIG. 2, the image forming unit 12 has a well-known configuration and includes a photoconductor drum 12*a*, a primary transfer roller 12*b*, an intermediate transfer belt 12*c*, a driven roller 12*d*, a driving roller 12*f*, a secondary transfer roller 12*g*, an intermediate transfer belt cleaner 12*h*, a photoconductor cleaner 12*i*, a toner container 12*j*, a waste toner container 9, and the like.

The primary transfer roller 12*b*, the intermediate transfer belt 12*c*, the driven roller 12*d*, the driving roller 12*f*, and the secondary transfer roller 12*g* form a transfer unit 12*u*.

When an image is formed, the image forming unit 12 transfers a toner contained in the toner container 12*j* at a predetermined position of the photoconductor drum 12*a*. The image forming unit 12 rotates the intermediate transfer belt 12*c* with the driven roller 12*d* and the driving roller 12*f*. The image forming unit 12 causes the intermediate transfer belt 12*c* to pass through a portion between the photoconductor drum 12*a* to which a toner is transferred and the primary transfer roller 12*b*. The image forming unit 12 transfers the toner from the photoconductor drum 12*a* to the intermediate transfer belt 12*c* while causing the intermediate transfer belt 12*c* to pass through a portion between the photoconductor drum 12*a* and the primary transfer roller 12*b*.

The image forming unit 12 causes the paper P to pass through a portion between the intermediate transfer belt 12*c* and the secondary transfer roller 12*g*. The image forming unit 12 transfers the toner from the intermediate transfer belt 12*c* to the paper P while causing the paper P to pass through a portion between the intermediate transfer belt 12*c* and the secondary transfer roller 12*g*.

The toner that is not transferred to the intermediate transfer belt 12*c* and remains on the photoconductor drum 12*a* is collected by the photoconductor cleaner 12*i*. The toner that is not transferred to the paper P and remains on the intermediate transfer belt 12*c* is collected by the intermediate transfer belt cleaner 12*h*. The toner collected in the photoconductor cleaner 12*i* and the intermediate transfer belt cleaner 12*h* is discharged into the waste toner container 9 as a waste toner. The waste toner container 9 is detachable from the image processing apparatus 1. Generally, the waste toner container 9 is periodically replaced by a maintenance manager of a manufacturer of the image processing apparatus 1.

The paper containing unit 14 includes a plurality of paper feeding devices (paper feeding units) 2 that are disposed in a space S under the main body B of the image processing apparatus 1 and are arranged in the up-down direction. The paper feeding device 2 supplies the paper P to the image forming unit 12. The paper feeding device 2 includes a paper feed cassette 3, a pickup roller 4, a rotating tray (not illustrated).

The paper feed cassette 3 places and stores the paper P before being processed by the image processing apparatus 1. The paper feed cassette 3 has a box-like shape in which the paper P opens upward. The paper feed cassette 3 is inserted into and removed from the image processing apparatus 1 in the depth direction.

The pickup roller 4 conveys the paper P backwards from the paper feed cassette 3 to the paper conveyance path 6 in the front-rear direction. As illustrated in FIG. 2, the pickup roller 4 is in contact with the upper surface of the paper P placed on the paper feed cassette 3 on the front end side. The pickup roller 4 includes a drive mechanism (not illustrated) including a motor and the like. The pickup roller 4 rotates by an action of the driving mechanism and conveys the paper P from the paper feed cassette 3 to the paper conveyance path 6.

The rotating tray supports the paper P so that the front end is positioned above the rear end, and brings the upper surface of the paper P into contact with the pickup roller 4. A rotating tray is rotatably provided in the paper feed cassette 3. The rotating tray has a plate-like shape and is connected to the paper feed cassette 3 via a rotating shaft parallel to the depth direction. The rotating tray is disposed below the front end side of the paper P, is biased by, for example, a spring, and can rotate the paper P such that the front end is positioned above the rear end.

The paper P is conveyed from the paper feeding devices 2 to the image forming unit 12 via the paper conveyance path 6. In the paper conveyance path 6, between the paper feeding devices 2 and the image forming unit 12 a paper feeding roller (not illustrated) and a separating roller (not illustrated) are disposed to be adjacent to each other. In the paper conveyance path 6, a pair of registration rollers (paper conveying rollers) 8 are disposed between the paper feeding devices 2 and the image forming unit 12 on the image forming unit 12 side with respect to the paper feeding roller and the separating roller.

When one or more sheets of the paper P are conveyed from the paper feeding devices 2, the paper feeding roller and the separating roller convey only one sheet of the paper P to the image forming unit 12 side. The paper feeding roller and the separating roller include driving mechanisms including motors or the like. The paper feeding roller and the separating roller are rotated by actions of the driving mechanisms while being in contact with the paper P and convey the paper P to the image forming unit 12 side. The paper feeding roller and the separating roller convey only one sheet of the paper P to the image forming unit 12 side, for example, by a known retard system, a comb-tooth system or the like.

The pair of registration rollers 8 synchronizes with the transfer unit 12*u* on which a toner image of the image forming unit 12 is formed, and conveys the paper P to the image forming unit 12. The pair of registration rollers 8 includes driving mechanisms (not illustrated) including motors or the like. The pair of registration rollers 8 is rotated by actions of the driving mechanisms while being in contact with the paper P and conveys the paper P. The pair of registration rollers includes a first registration roller 8*a* and a second registration roller 8*b*. The first registration roller 8*a* includes an axis 8*o* parallel to the depth direction. The first registration roller 8*a* is in contact with a surface Pp on which an image of the paper P is formed and conveys the paper P.

Figure 3:
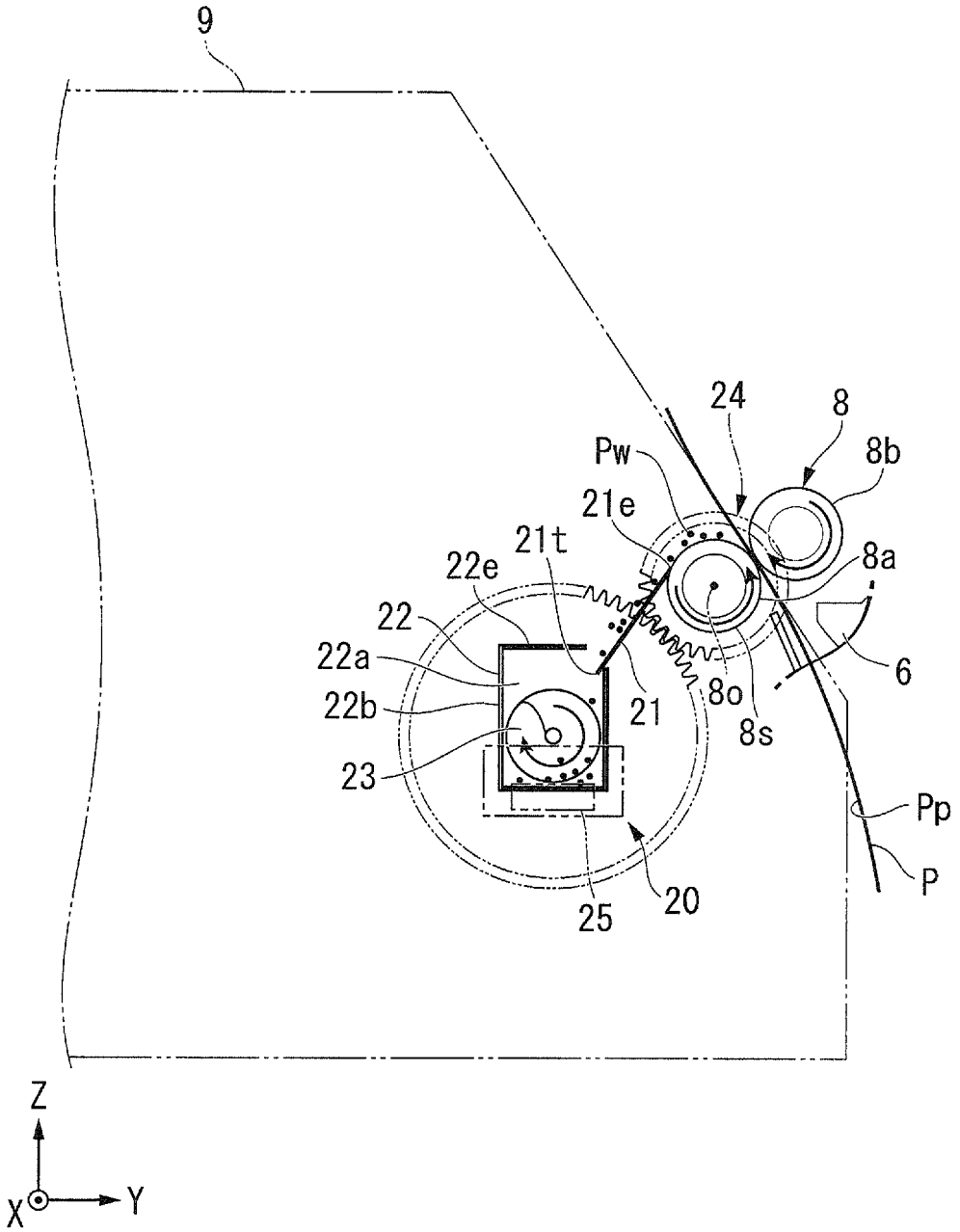
FIG. 3 a front view of a paper dust collecting mechanism included in the image processing apparatus.

FIG. 3 is a front view of the paper dust collecting mechanism 20 included in the image processing apparatus 1. As illustrated in FIG. 3, the paper dust collecting mechanism 20 includes a scraping blade 21, a reservoir 22, a conveying paddle 23, a gear (reduction gear) 24, and a transfer path 25.

The scraping blade 21 removes paper dust Pw adhering to the first registration roller 8*a*. The scraping blade 21 has a rectangular film-like shape. The scraping blade 21 is disposed so that the surface direction is parallel to the axis 8*o* of the first registration roller 8*a*. The scraping blade 21 is disposed such that a first end portion 21*e* in the surface direction abuts on a surface 8*s* of the first registration roller 8*a*. The scraping blade 21 is disposed to abut on an entire portion of the first registration roller 8*a* in the direction of the axis 80. The scraping blade 21 is disposed so that a second end portion 21*t* on the opposite side to the first end portion 21*e* in the surface direction is positioned below the first end portion 21*e*.

The reservoir 22 contains the paper dust Pw removed by the scraping blade 21. The reservoir 22 includes a box portion 22*b* and a paper scattering prevention cover 22*e*.

Figure 4:
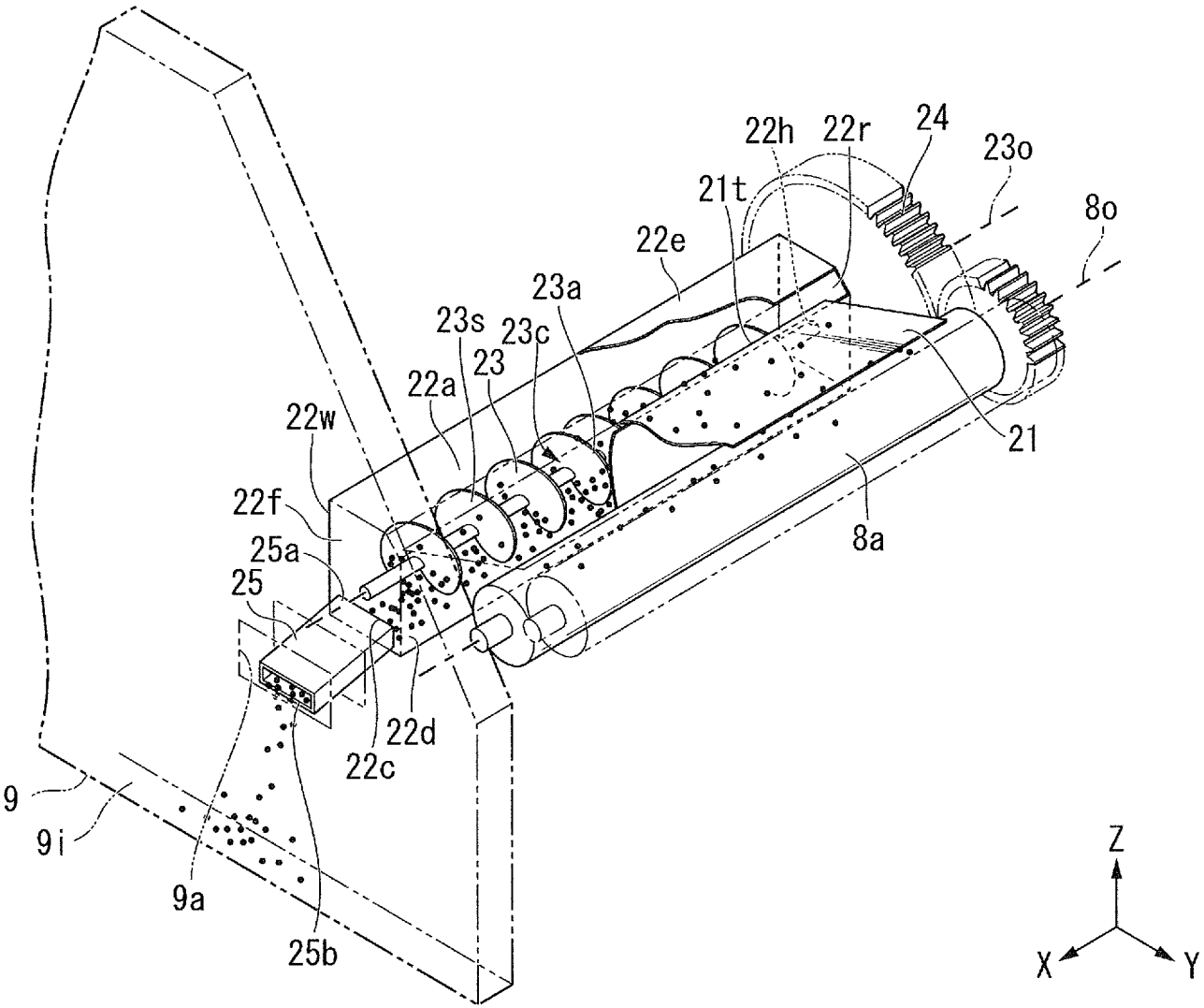
FIG. 4 is a perspective view of the paper dust collecting mechanism.

The box portion 22*b* has a box-like shape that opens upward. The second end portion 21*t* of the scraping blade 21 is inserted into a containing space 22*a* of the box portion 22*b* from the first registration roller 8*a* side. FIG. 4 is a perspective view of the paper dust collecting mechanism 20. As illustrated in FIG. 4, a circular through hole 22*h* is formed on an inner side surface 22*r* of the box portion 22*b*. A bottom portion 22*d* of the box portion 22*b* is inclined downward from the inner side toward the front side. A rectangular connection port 22*c* is formed on the a side surface 22*f* on the front side of the box portion 22*b*. The connection port 22*c* is formed in the lowermost portion of the side surface 22*f*.

As illustrated in FIG. 3, the paper scattering prevention cover 22*e* covers a portion of the containing space 22*a* of the box portion 22*b* from the upper side. The paper scattering prevention cover 22*e* protrudes from the side surface 22*w* on the opposite side to the first registration roller 8*a* of the box portion 22*b*.

As illustrated in FIG. 4, the conveying paddle 23 conveys the paper dust Pw contained in the reservoir 22 to the connection port 22*c*. The conveying paddle 23 is disposed to the containing space 22*a* of the reservoir 22. The conveying paddle 23 includes a shaft 23*a* and a screw 23*s*. The shaft 23*a* includes an axis 23*o* parallel to the axis 8*o* of the first registration roller 8*a*. The shaft 23*a* passes through the through hole 22*h* of the inner side surface 22*r* of the reservoir 22.

The screw 23*s* revolves in a circumferential direction of the shaft 23*a* and is formed in a helical shape that progresses to the front side in the direction of the axis 23*o*. The screw 23*s* is formed to be denser as being closer to the central portion 23*c* in the direction of the axis 23*o* of the shaft 23*a* and is formed to be sparser as being farther from the central portion 23*c*.

Figure 5:
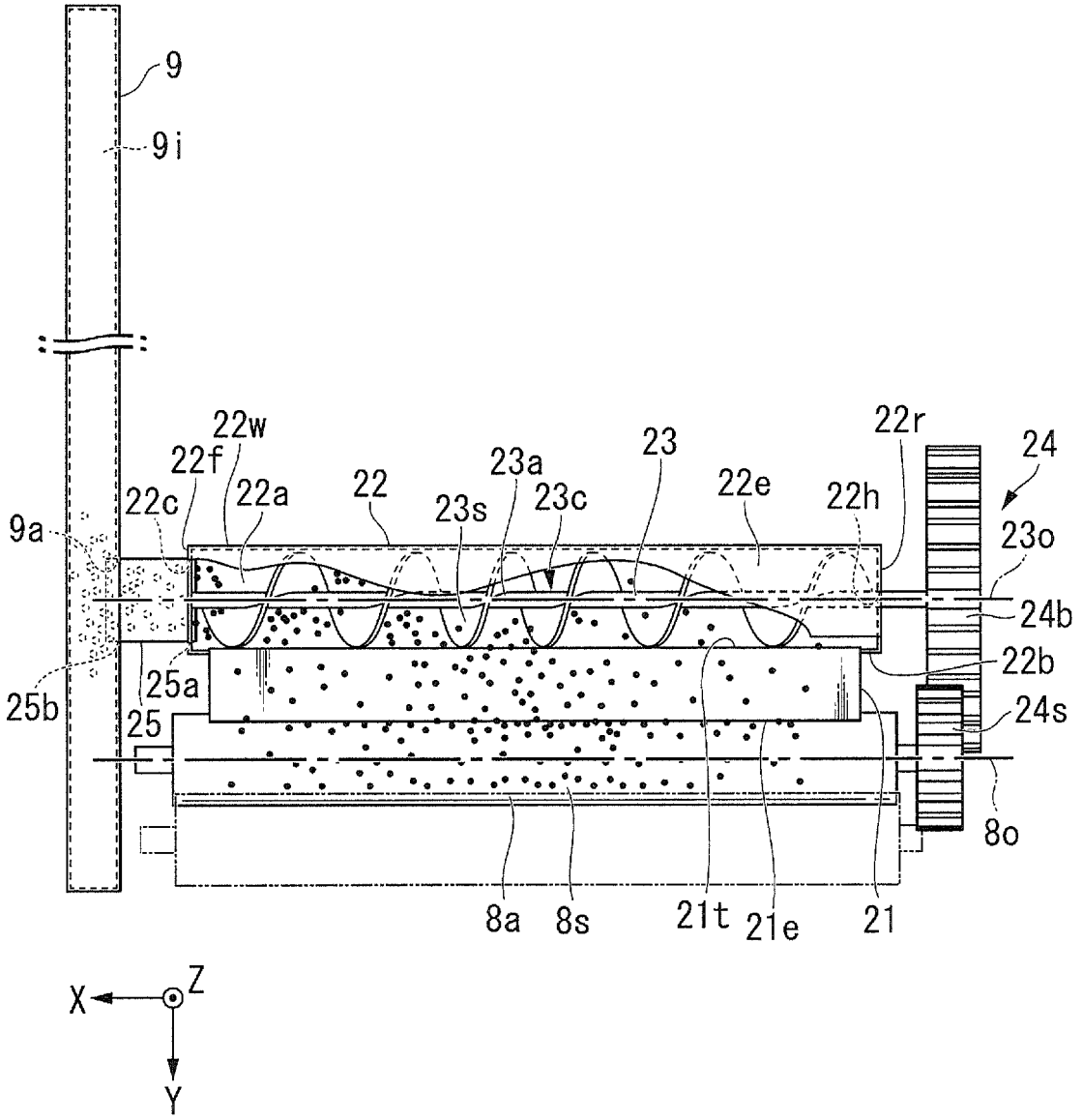
FIG. 5 is a plan view of the paper dust collecting mechanism.

The gear 24 is interposed between the first registration roller 8*a* and the conveying paddle 23, and causes the conveying paddle 23 to interlock with the first registration roller 8*a*. FIG. 5 is a plan view of the paper dust collecting mechanism 20. As illustrated in FIG. 5, the gear 24 includes a small gear 24*s* and a large gear 24*b*. The small gear 24*s* is mounted in the end portion on the inner side of the first registration roller 8*a*. The large gear 24*b* is mounted in the end portion on the inner side of the conveying paddle 23. The small gear 24*s* and the large gear 24*b* are disposed to mesh with each other.

The transfer path 25 connects the containing space 22*a* of the reservoir 22 and an inside portion 9*i* of the waste toner container 9. The transfer path 25 has a cylindrical shape. An edge 25*a* of an opening on one side of the transfer path 25 is joined to an edge of the connection port 22*c* of the reservoir 22. An edge 25*b* on the other side of the transfer path 25 is disposed to closely attach to an edge of an inlet 9*a* through the inside portion 9*i* of the waste toner container 9.

Hereinafter, an action when an image is formed by the image processing apparatus 1 and the paper dust collecting mechanism 20 operates is described. First, a user instructs through the control panel unit 13 or the like illustrated in FIG. 1 that the controller 1*c* of the image processing apparatus 1 illustrated in FIG. 2 forms a predetermined image on the paper P.

The controller 1*c* that received the instruction operates the image forming unit 12 and causes a toner in a predetermined color to adhere to a portion corresponding to a predetermined image of the transfer unit 12*u*. The controller 1*c* rotates the pickup roller 4 and conveys the paper P from the paper feed cassette 3 to the paper conveyance path 6. The controller 1*c* rotates the paper feeding roller and the separating roller and conveys one sheet of paper P to the pair of registration rollers 8. As illustrated in FIG. 2, the controller 1*c* rotates the pair of registration rollers 8 in synchronization with the transfer unit 12*u* and conveys the paper P from the pair of registration rollers 8 to the transfer unit 12*u*.

The pair of registration rollers 8 rotates in contact with the paper P and conveys the paper P to the transfer unit 12*u*. The first registration roller 8*a* of the pair of registration rollers 8 is in contact with the surface Pp on which the image of the paper P is formed. As illustrated in FIG. 3, the paper dust Pw is transferred from the surface Pp on which the image is formed to the surface 8*s* of the first registration roller 8*a*.

The paper dust Pw transferred to the surface 8*s* of the first registration roller 8*a* is scraped by the scraping blade 21 abutting to the surface 8*s* by the rotation of the first registration roller 8*a*. The paper dust Pw scraped by the scraping blade 21 slides on the upper surface of the scraping blade 21 and is contained in the reservoir 22.

As illustrated in FIG. 4, the reservoir 22 moves the paper dust Pw to the front side by the gravity by the inclination of the bottom portion 22*d* to the front side.

The conveying paddle 23 disposed in the containing space 22*a* of the reservoir 22 rotates in connection with the rotation of the first registration roller 8*a* via the gear 24. As illustrated in FIG. 3, the conveying paddle 23 rotates to convey the paper dust Pw to the front side by the screw 23*s*.

By the inclination of the bottom portion 22*d* or the action of the conveying paddle 23, the paper dust Pw moves to the connection port 22*c* of the reservoir 22. The paper dust Pw moved to the connection port 22*c* is contained in the inside portion 9*i* of the waste toner container 9 through the transfer path 25.

According to the image processing apparatus 1 of the exemplary embodiment, the paper dust Pw transferred from the paper P to the first registration roller 8*a* is scraped by the scraping blade 21. The paper dust Pw scraped by the scraping blade 21 is stored in the reservoir 22. The paper dust Pw stored in the reservoir 22 moves to the connection port 22*c* of the reservoir 22 by the inclination of the bottom portion 22*d* or the conveying paddle 23. The paper dust Pw moves to the connection port 22*c* is contained in the inside portion 9*i* of the waste toner container 9 through the transfer path 25. The waste toner container 9 is periodically removed from the image processing apparatus 1 and replaced. Therefore, the paper dust Pw stored in the reservoir 22 is removed from the image processing apparatus 1 with the replacement of the waste toner container 9 without requiring new labor.

According to the image processing apparatus 1 of the exemplary embodiment, by causing the reservoir 22 to include the paper scattering prevention cover 22*e*, the paper dust Pw is prevented from scattering from the reservoir 22.

According to the image processing apparatus 1 of the exemplary embodiment, the first registration roller 8*a* and the conveying paddle 23 interlock via the gear 24, and rotation directions are opposite to each other. The paper scattering prevention cover 22*e* protrudes from a side surface 22*w* on the opposite side of the first registration roller 8*a* of the reservoir 22. Therefore, even when the paper dust Pw flies due to the rotation of the conveying paddle 23, the paper dust Pw hits the paper scattering prevention cover 22*e* and is not likely to scatter from the reservoir 22.

According to the image processing apparatus 1 of the exemplary embodiment, as the screw 23*s* of the conveying paddle 23 is closer to a central portion 23*c* in the direction of the axis 23*o* of the shaft 23*a*, the screw 23*s* is formed to be denser, and as the screw 23*s* is farther from the central portion 23*c*, the screw 23*s* is formed to be sparser. Therefore, a large amount of paper dust Pw moves from a portion where the paper dust Pw easily accumulates near the center position of the paper P in the reservoir 22.

According to the image processing apparatus 1 of the exemplary embodiment, the small gear 24*s* is mounted on the first registration roller 8*a*, and the large gear 24*b* is mounted on the conveying paddle 23. The rotation speed of the conveying paddle 23 is smaller than the rotation speed of the first registration roller 8*a*. Therefore, when the conveying paddle 23 conveys the paper dust Pw, the paper dust Pw can be prevented from flying.

The paper feeding unit that places and stores the paper P may not be the paper feeding devices 2, but may be a manual feed tray.

The paper conveying roller provided with the paper dust collecting mechanism 20 may not be the registration roller 8, but may be another roller in contact with the paper P near a portion between the paper feeding unit and the image forming unit 12. The paper conveying roller provided with the paper dust collecting mechanism 20 is desirably disposed above the waste toner container 9.

The paper dust collecting mechanism may not include the scraping blade 21. The paper dust collecting mechanism may convey only the paper dust Pw naturally dropped to the reservoir 22, to the waste toner container 9, by disposing the reservoir 22 below the paper conveying roller.

The reservoir may not include the paper scattering prevention cover 22*e*. As long as the rotation speed of the conveying paddle 23 does not reach the level of causing the paper dust Pw to fly, the paper scattering prevention cover 22*e* is not required.

The paper dust collecting mechanism 20 may not include the conveying paddle 23. Even if the conveying paddle 23 is not included, the paper dust collecting mechanism 20 conveys the paper dust Pw to the transfer path 25 by the inclination of the bottom portion 22*d* of the reservoir 22 and contains the paper dust Pw in the inside portion of the waste toner container 9.

The reduction gear that cause the first registration roller 8*a* and the conveying paddle 23 to interlock may not be the gear 24, but may be a timing pulley, a timing belt, or the like.

The transfer path 25 may not be joined to the reservoir 22 and closely attached to the waste toner container 9, but may be closely attached to the reservoir 22 and joined to the waste toner container 9.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image processing apparatus, comprising:

a paper feeding unit on which paper is placed;

an image forming unit that is provided in an inside portion of the image processing apparatus and forms an image on the paper supplied from the paper feeding unit;

a paper conveying roller that is provided in the inside portion of the image processing apparatus, and conveys the paper from the paper feeding unit by rotation in contact with the paper;

a reservoir that contains paper dust removed from the paper conveying roller and includes a bottom portion;

a waste toner container that is disposed below the reservoir in a vertical direction, is detachable from the image processing apparatus, and contains a waste toner discharged from the image forming unit; and a transfer path that connects an inside portion of the reservoir and an inside portion of the waste toner container.

2. The image processing apparatus according to claim 1, wherein the paper conveying roller conveys the paper toward the image forming unit.

3. The image processing apparatus according to claim 1, further comprising:

a scraping blade that abuts to the paper conveying roller and removes the paper dust transferred from the paper to the paper conveying roller.

4. The image processing apparatus according to claim 1, further comprising:

a conveying paddle comprising a shaft that is disposed in the reservoir and extends along an axis direction of the paper conveying roller to the transfer path and a screw that revolves in a circumferential direction of the shaft and is formed in a helical shape that progresses in the axis direction.

5. The image processing apparatus according to claim 4, wherein the conveying paddle interlocks with the paper conveying roller.

6. The image processing apparatus according to claim 5, wherein the paper conveying roller and the conveying paddle are connected to each other via a reduction gear.

7. The image processing apparatus according to claim 4, wherein a rotation direction of the conveying paddle is opposite to a rotation direction of the paper conveying roller.

8. The image processing apparatus according to claim 4, wherein the screw has a density higher closer to a central portion in the axis direction than away from the central portion.

9. The image processing apparatus according to claim 1, wherein the bottom portion is inclined so that the transfer path is lowermost.

10. The image processing apparatus according to claim 1, wherein the reservoir comprising a paper scattering prevention cover.

11. A paper dust collection mechanism, comprising:

a paper conveying roller that conveys the paper from a paper feeding unit by rotation in contact with the paper;

a reservoir that contains paper dust removed from the paper conveying roller and includes a bottom portion;

a waste toner container that is disposed below the reservoir in a vertical direction, is detachable from an image processing apparatus, and contains a waste toner discharged from an image forming unit; and a transfer path that connects an inside portion of the reservoir and an inside portion of the waste toner container.

12. The paper dust collection mechanism according to claim 11, wherein the paper conveying roller conveys the paper toward the image forming unit.

13. The paper dust collection mechanism according to claim 11, further comprising:

a scraping blade that abuts to the paper conveying roller and removes the paper dust transferred from the paper to the paper conveying roller.

14. The paper dust collection mechanism according to claim 11, further comprising:

a conveying paddle comprising a shaft that is disposed in the reservoir and extends along an axis direction of the paper conveying roller to the transfer path and a screw that revolves in a circumferential direction of the shaft and is formed in a helical shape that progresses in the axis direction.

15. The paper dust collection mechanism according to claim 14, wherein the conveying paddle interlocks with the paper conveying roller.

16. The paper dust collection mechanism according to claim 14, wherein a rotation direction of the conveying paddle is opposite to a rotation direction of the paper conveying roller.

17. The paper dust collection mechanism according to claim 14, wherein the screw has a density higher closer to a central portion in the axis direction than away from the central portion.

18. A paper dust collection method, comprising:

forming an image on paper supplied from a paper feeding unit by an image forming unit;

conveying paper from the paper feeding unit by rotation of a paper conveying roller in contact with the paper;

removing paper dust from the paper conveying roller and delivering the paper dust to a reservoir including a bottom portion;

collecting waste toner discharged from the image forming unit in a waste toner container disposed below the reservoir in a vertical direction, the waste toner container detachable from the image processing apparatus; and collecting paper dust in the waste toner container via a transfer path connecting an inside portion of the reservoir and an inside portion of the waste toner container.

19. The paper dust collection method according to claim 18, wherein the paper conveying roller conveys the paper toward the image forming unit.

20. The paper dust collection method according to claim 18, further comprising:

removing the paper dust transferred from the paper to the paper conveying roller using a scraping blade that abuts to the paper conveying roller.

* * * * *